United States Patent [19]

Miyamae

[11] 4,198,765

[45] Apr. 22, 1980

[54] SHOE DRYER WITH AN ORTHOPAEDIC MEANS

[76] Inventor: Toshiaki Miyamae, 2-16, 2-chome, Nishi-Iwata, Higashi-Osaka, Osaka 577, Japan

[21] Appl. No.: 947,016

[22] Filed: Sep. 29, 1978

[30] Foreign Application Priority Data

| | | | |
|---|---|---|---|
| Oct. 21, 1977 | [JP] | Japan | 52-142386[U] |
| May 22, 1978 | [JP] | Japan | 53-68759[U] |
| May 23, 1978 | [JP] | Japan | 53-70098[U] |
| Jun. 19, 1978 | [JP] | Japan | 53-84446[U] |

[51] Int. Cl.[2] ..... F26B 23/10

[52] U.S. Cl. ..... 34/104; 12/129.4; 219/373; 219/367; 219/370

[58] Field of Search ..... 34/104, 103, 202, 21; 12/53.2, 129.4; 219/366, 367, 368, 369, 370, 371, 373, 374, 215

[56] References Cited

U.S. PATENT DOCUMENTS

| | | | |
|---|---|---|---|
| 386,746 | 7/1888 | Hess | 34/104 |
| 686,314 | 11/1901 | Mansfield | 34/104 |
| 2,098,735 | 11/1937 | Yentis | 34/104 X |
| 3,154,392 | 10/1964 | Littman | 34/104 |
| 3,203,112 | 8/1965 | Edmonds | 34/104 |
| 4,085,519 | 4/1978 | Masika | 34/104 |

FOREIGN PATENT DOCUMENTS

| | | | |
|---|---|---|---|
| 265061 | 6/1963 | Australia | 219/373 |
| 2227907 | 12/1973 | Fed. Rep. of Germany | 34/104 |
| 391690 | 5/1933 | United Kingdom | 12/129.4 |

*Primary Examiner*—Lloyd L. King
*Assistant Examiner*—Harold Joyce
*Attorney, Agent, or Firm*—Moonray Kojima

[57] ABSTRACT

The present invention is concerned with a novel construction of a shoe dryer having at least a pair of flexible blow pipes detachably mounted to one side of a main body housed with a motor, a sirroco fan, a heating means and a timeswitch, wherein an orthopaedic instep plate and an auxiliary supporting frame are rigidly fixed to a nozzle means mounted to the foremost end of said each flexible blow pipe thereby to reform a shapeless shoe internally thereof, the orthopaedic instep plate being adapted to restrictively support the auxiliary supporting frame thereby to regulate the elastic deformation of the latter frame, and an regenerative plate axially inflated and detachably engaged with the frame.

2 Claims, 8 Drawing Figures

SHOE DRYER WITH AN ORTHOPAEDIC MEANS

The present invention relates generally to improvements in a shoe dryer, and more particularly to an improved construction of a small sized and light weighted portable type shoe drying instrument which is equipped with an orthopaedic mechanism and applicable to any type and shape of shoes, boots and scuffles for ladies, gentlemen and children.

For preservation of shoes, it is desirable to dry up these in the shade normally exposed to the air for a considerable length of time after having cleaned the same neatly. However, it is almost impossible for the daily shod men to add an extra painstaking trouble to their miscellaneous personal affairs. At best they might take up the shoes they kicked off on previous night and reluctantly brush up the outer surface thereof, then go out putting on the superficially polished shoes, fancying themselves that the shoes are now neatly cleaned. Thus the reality is that their shoes are always left internally squalor, wet with sweat oozed out of the sole of their feet and with moisture impregnated into the shoes from the outside.

Accordingly, the present invention has been designed to solve all the above-mentioned problems and has for one of its main objects the provision of a shoe dryer that can promptly and exactly dry up any kind of footgears such as low shoes, high leg boots and fabric shoes, at the same time sterilizing the inside thereof so as to always keep the footgears hygienic, ensuring for men the easiness to walk in and making these protractedly good for wear.

Another object of the invention is to provide a shoe dryer equipped with an orthopaedic mechanism that can restore any shapeless portion of a shoe to its original shape.

A further object of the invention is to provide a shoe dryer which is small in size and light in weight with its elemental parts formed detachably thereby making it possible to easily carry the shoe dryer with a user and freely use it in a corner of a limited space.

How the foregoing objects and advantages are attained will appear more fully from the following description referring to the accompanying drawings, in which.

Figure 1:
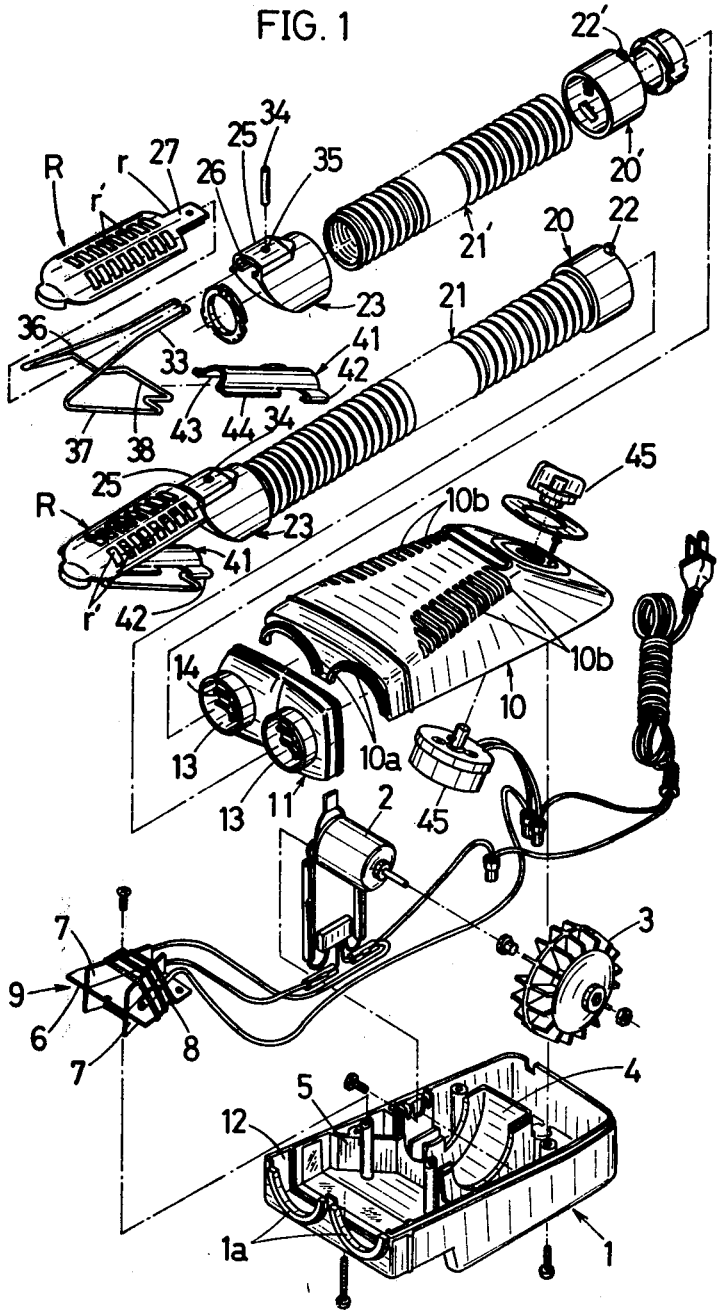
FIG. 1 is an exploded view in perspective of a preferred embodiment of the invention illustrating the internal parts of an embodiment as they appear during asssembly thereof.

Setting forth now in detail a few preferred embodiments of the present invention with reference to the accompanying drawings, reference numeral 1 generally designates a casing in which there are mounted an A.C. motor 2 and a sirroco fan 3 which is disposed substantially intermediate of the casing 1 and driven by the motor 2. Said fan 3 is enclosed with a wall 4 that terminates into blow guide wings 5. Numeral 6 is a plate element which is composed preferably of such an adiabatic material for example as asbestus and provided at both sides thereof with projected bilateral tongues 7 adapted to equally divide a quantity of air from the fan 3. Said plate element 6 is wound with a Nichrome wire 8 to form a heating plate 9, being disposed just in front of the fan 3 at an angle subject to the least resistance of the air from the fan 3. While passing through said heating plate 9, the air from the fan 3 is heated to warm air.

Incidentally said heating plate 9 may be replaced with a heater unit (not shown in the accompanying drawings) composed of a semi-conductor. On one side of said casing 1 there are formed a pair of arcuate flanges **1*a* in symmetrical relation while on one side of a lid 10 which is to be put on said casing 1 there are also formed a pair of arcuate flanges 10*a* that correspond to the former flanges 1*a***.

Figure 2:
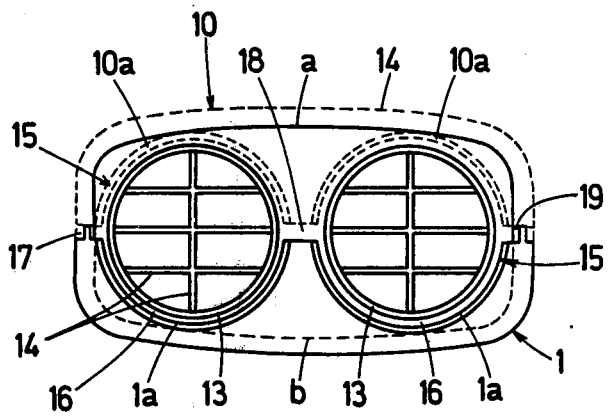
FIG. 2 is a sectional side elevation view showing a main body of the invention wherein a partition held between a casing and a covering is shown by a solid line and a broken line, respectively.

In front of said heating plate 9 there is mounted a partition 11 through a groove 12 that is formed inside the casing **1*a*. As shown in FIGS. 1 and 2, said partition 11 is formed integrally with a pair of hoods 13 each formed with a latticework 14 and centrally aligned with the plane surface of said plate element 6. Incidentally, when the partition 11 is held between the casing 1 and the lid 10, the contour thereof is defined as shown by a solid line a and a broken line b, respectively, in FIG. 2**.

In this case, each pair of said arcuate flanges **1*a* and 10*a* combined form a circular flange 15 whose inner diameter is greater than the outer diameter of the hood 13. Through an opening of said circular flange 15 there is protruded said hood 13 in concentral relation so as to form a ring shape space 16 which is intercommunicated with the partition 11 between the outer periphery of the hood 13 and the inner periphery of the circular flange 15. Further between the opposed ends of said arcuate flanges 1*a* and 10*a* there are formed spaces 17, 18 and 19 which are also intercommunicated with the partition 11**.

Figure 3:
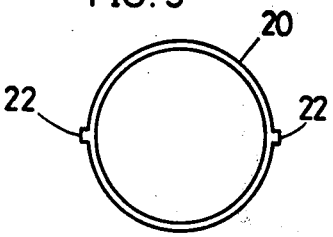
FIG. 3 is a cross-sectional view showing a connecting means for connecting a flexible blow pipe to the main body.

Into said spaces 16, 17 and 18 there is inserted a connection ring 20 fixed to one end of a flixible blow pipe 21 through a pair of projections 22 integrally formed on the outer peripheral edge of the connection ring 20 while another connection ring 20' fixed to one end of another flexible blow pipe 21' is also inserted into the spaces 16, 18 and 19 through projections 22' which are integrally formed on the outer peripheral edge of the latter ring 20', as clearly shown in FIGS. 1 to 3, inclusive. Thereafter each of said connection rings 20, 20' is turned at a suitable angle thereby to fix each flexible blow pipe 21, 21' in a position being fed with the maximal quantity of warm air through the hood 13.

Figure 4:
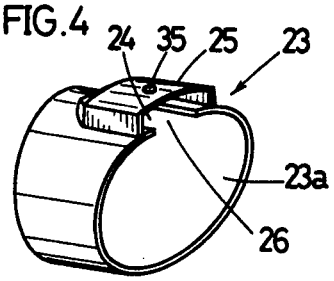
FIG. 4 is a perspective view of a nozzle fixed in one end of the flexible blow pipe and having a construction for connecting a reforming plate to the nozzle means.
Figure 5:
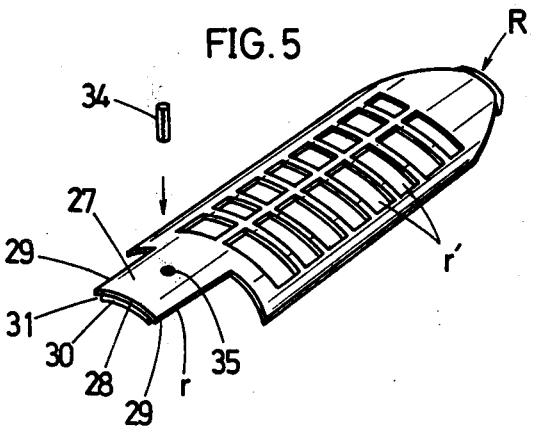
FIG. 5 is a perspective view of the reforming plate which is to be connected to the nozzle means.
Figure 6:
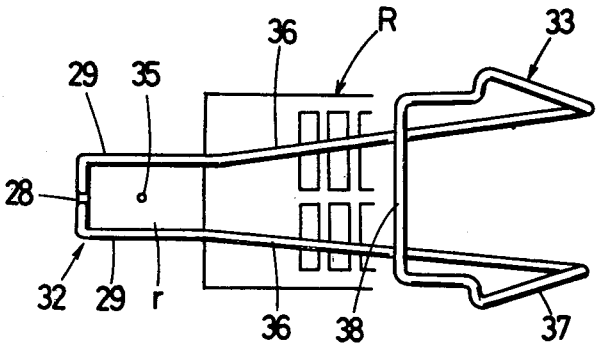
FIG. 6 is a bottom plan view showing a reforming frame to be connected to the nozzle means together with the reforming plate.

Numeral 23 in FIG. 4 is a nozzle fixedly connected to that end of said flexible blow pipe 21 or 21' which is opposite to the connection ring 20 or 20'. Said nozzle 23 has its uppermost edge engraved with a notched portion 24 on which there is integrally formed an inflated hollow portion 25. Through an opening 26 formed in the foremost end of the inflated hollow portion 25 protrudedly from said uppermost edge of the nozzle 23 there is inserted a fixing portion r of a reforming plate R which is in the form of an orthopaedic instep support, as clearly shown in FIG. 5. Said reforming plate R is formed into an arcuate cross section in conformity with the instep of a shoe and bored with a plurality of vents r' in the portion thereof corresponding to said instep.

Said fixing portion r has its upper surface 27 fitly corresponding to the inner upper surface of the inflated hollow portion 25, with its front face 28 and both sides 29 engraved with grooves 30, 31 so as to receive therein each bent end 32 of an auxiliary reforming frame on supporting frame 33.

Accordingly, when the reforming plate R and the supporting frame 33 are forced through the opening 26 into the inflated hollow portion 25, with the bent ends 32 of said frame 33 fitted to said grooves 30, 31 of the fixing portion r, the reforming plate R is held within the inflated hollow portion 25 to tightly hold the supporting frame 33 therebetween. Thereafter a cotter pin 34 is formed into a through hole 35 bored on the upper surface of the inflated hollow portion 25 and the fixing portion r in common whereby the reforming plate R and the supporting frame 33 are inseparably secured to the nozzle 23.

In the foregoing embodiment, reference has been made to the case wherein the nozzle 23 is engraved with a notched portion 24 along the uppermost edge thereof while the inflated hollow portion 25 and the fixing portion r are inseparably fixed to the nozzle 23 by inserting the pin 34 into the hole 35. However, another embodiment may also be proposed wherein a pin is inserted into a through hole (not shown) bored in common with the upper surface of the inflated hollow portion 25, the fixing portion r and the uppermost edge portion of the nozzle 23 thereby dispensing with much labour of engraving the notched portion 24 on the nozzle 23, additionaly to the advantage that the same inseparably fixed relation as in the preceding embodiment is secured between the inflated hollow portion 25, the fixing portion r and the nozzle 23.

Said supporting frame 33 is preferably made of a slender resilient steel on synthetic resin and comprises bilateral linear portions 36 spreading outwardly of said bent ends 32 so as to resiliently support the reforming plate R from the backside thereof when the plate R is forced into a shoe whose instep and vamp are deformed full of many creases produced by the upward bending motion of the instep of a man's foot each time he steps, bilateral insole pressing portions 37 that extend on the plane from the end of said portion 32 after being bent in the same direction and an acute angle with respect to said end and a communicated portion 38 in which the portions 37 terminate.

Figure 7:
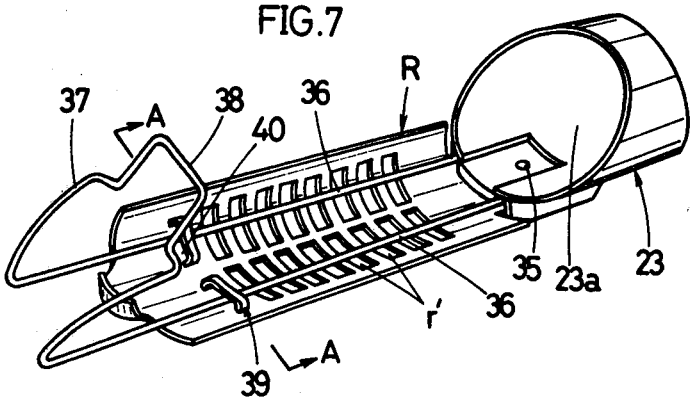
FIG. 7 is a perspective view showing the structure of a regulating means formed at one side of the reforming plate so as to regulate the elastic deformation of the reforming frame.
Figure 8:
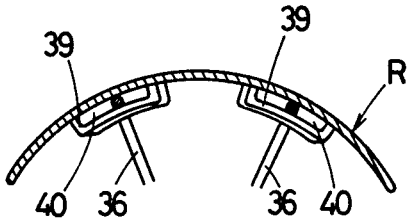
FIG. 8 is a vertical section view taken on the line of A—A in FIG. 7.

As shown in FIG. 7, the reforming plate R is provided at one side thereof with frame regulators 29 formed symmetrically in suitable positions transversing the axis of the plate R. Said frame regulator 39 is bored with a slit 40 which is slightly larger than the diameter of said linear portion 36. Through the slit 40 said linear portion 36 is movably inserted into the frame regulator 39.

Thus when use is made of the shoe dryer equipped with the abovementioned orthopaedic mechanism in accordance with the present invention, it will be understood that the supporting frame 33 forces up the deformed instep of a shoe in support of the reforming plate R and resiliently expands the quarters, vamp and counter of the shoe to a suitable degree thereby to restore the shapeless portion of the shoe to its original fine shape. Further in case said supporting frame 33 is applied to the extremely shapeless portions of a shoe, the elastic deformation of the linear portions 36 is regulated by the slit 40 of the frame regulator 39 so that the regulated elasticity acts to strengthen the reforming power of the supporting frame 33.

To the insole pressing portions 37 of the supporting frame 33 there is mounted a regenerative plate 41 slidably and detachably through inward bent pieces 42 formed in the end thereof as shown in FIG. 1.

Preferably said regenerative plate 41 is formed into a gable roof shape by pressing a sheet of such a metal having a high thermal conductivity for example as copper. The end of the regenerative plate 41 opposite to the inward bent pieces 42 is cut aslant toward the uppermost edge of the plate 41 to form a skew arch opening 43 to face the inner toe cap of a shoe.

Furthermore, the regenerative plate 41 is formed along the lowermost edges thereof with a pair of wide-soled legs 44 to directly contact the upper insole surface of the shoe.

Referring now to the operation and functional effect of the shoe dryer embodying the present invention, the reforming plate R is forced into a shoe to reform it by stretching the distorted portion thereof while facing blowhole 23*a* of the nozzle 23 in a suitable position to the inside of the shoe, and then a timeswitch 45 is set to operate. In this cae, air inhailed through vents 103 of the lid 10 into the casing 1 by the sirroco fan 3 is fed to the heating plate 9, heated thereon as it passes, and further fed to the hood 13 thereby being bisected into two streams of heated air having an equal quantity and an equal wind pressure.

Then a certain quantity of the heated air fed into the shoe passes through vents 48 of the reforming plate R to the inner instep of the shoe while another quantity directly advances along the plate R without being hindered by the existence of the supporting frame 33, until it abuts against the inner toe cap and is at last turned to the regenerative plate 41 through the gable opening thereof whereby the plate 41 is heated up to a suitable ionic temperature to produce ion for sterilizing all the inside portions of the shoe.

Further even after the supply of heated air is halted, the remaining heat of the regenerative plate 41 continues the drying and sterilizing operatios for a considerable length of time.

In the preceding embodiment, reference has been made to the construction of an arch roof shape regenerative plate mounted slidably and detachably to the supporting frame 33. However, said construction may be replaced, for example, with a cylinder having its one end pivotally supported on the communicated portion 39 of the supporting frame 33 or otherwise with a honeycombed regenerative plate comprising a plurality of small-diameter cylinders having their one end pivotally supported on said portion 39.

According to the present invention, it is possible to use the shoe dryer by placing it stable on a plane surface or hang it on the wall or a pillar subject to the shape of shoes or a place where the shoes are to be dried. Further when not in use, the shoe dryer of the invention may be changed into a portable stowing size by disengaging the connection rings from the main body.

There will now be obvious to those skilled in the art many modifications and variations of the above-described structure. These modifications and variations will not depart from the scope of the invention defined by the following claims.

What is claimed is:

1. A shoe dryer with an orthopaedic means comprising a casing, a lid to be put thereon, a fan and a heating means housed in said casing, a partition wall having vents through which a quantity of air fed from said fan and heated by said heating means is divided into two streams having an equal air pressure and an equal quantity, said partition wall being fixedly held between edges of said casing and said lid, and flexible blow pipes each having an end connected to a connecting means detachably mountable to said wall through said edges of the casing and the lid, with the other end connected to a means for orthopaedically reforming a shapeless shoe to its original shape, and further comprising (a) at least a pair of vents bored in said partition wall just in front of said heating means, (b) a hood projected integrally from each of said vents on one side of said partition wall, (c) groove formed adjacent to each of said edges of the casing and the lid, (d) a semi-circular portion formed adjacent to said groove of said casing and said lid, (e) circular flanges having a greater inner diameter than the outer diameter of said hood, being formed by said opposed semi-circular flange portions when said casing and said lid are engaged with one another, (f) circular spatial rooms formed between said circular flanges and said hood in intercommunicable relation with said partition wall, (g) each spatial room formed between opposite ends of said semi-circular flange portions in intercommunicable relation with said partition wall, (h) a connecting means being in the form of a connecting ring rigidly fixed to one end of said flexible blow pipe, that has a greater inner diameter than the outer diameter of said hood but a smaller outer diameter than the inner diameter of said circular flange, (i) a pair of projections formed integrally on the outer peripheral edge of said connecting ring, and (j) construction wherein said connecting ring is detachably engageable to said vents of the partition wall through said circular spatial room and said spatial rooms of said circular flanges.

2. A shoe dryer with an orthopaedic means comprising a casing, a lid to be put thereon, a fan and a heating means housed in said casing, a partition wall having vents through which a quantity of air fed from said fan and heated by said heating means is divided into two streams having an equal air pressure and an equal quantity, said partition wall being fixedly held between edges of said casing and said lid, and flexible blow pipes each having an end connected to a connecting means detachably mountable to said wall through said edges of the casing and the lid, with the other end connected to a means for orthopaedically reforming a shapeless shoe to its original shape, and further comprising (a) a pair of nozzle means each fixedly connected to the end of said connecting ring opposite to said flexible blow pipe, having a foremost end formed axially with a notched portion across which an inflated hollow portion is formed, said means being cut aslant from said foremost end to form an elliptical opening, (b) a through hole bored in a suitable upper surface position of said inflated hollow portion, (c) a reforming plate which is formed into an arcuate cross-sectioned shape and provided in its one end with a fixing portion insertible into said inflated hollow portion while the other end is downwardly curved to form a toe cap portion, (d) a plurality of vents bored on said reforming plate substantially over the whole surface area thereof, (e) a through hole bored on said fixing portion in a position corresponding to said through hole of the inflated hollow portion, (f) at least a pair of regulating pieces integrally projected from an inwardly curved side of said reforming plate in symmetrically suitable positions transversing the axis of the plate, (g) a slit bored in said regulating piece to form a shape conformable with said inwardly curved side of the reforming plate, (h) a groove engraved along each side of said fixing portion of the reforming plate, (i) an auxiliary supporting frame having a smaller diameter than said slit of the regulating piece, which is made of either a steel or resilient synthetic resin, comprising a pair of bilaterally bent end portions corresponding to said groove of the fixing portion, a pair of linear portions extending in a dovetail shape from said bent end portions, a pair of insole pressing portions extending on a plane after being curved acutely in the same direction from said linear portions, and a communicated portion in which said insole pressing portions terminate, (j) construction formed so that said fixing portion of the reforming plate along with said pair of bent end portions of the auxiliary supporting frame fitted to said groove of the fixing portion of the reforming plate is inserted into said inflated hollow portion of the nozzle means, (k) a cotter pin to be forced into said through hole of the inflated hollow portion and said through hole of said fixing portion, (l) construction formed so that each of said linear portions of the auxiliary supporting frame is inserted into said slit of the regulating pieces whereby the elastic deformation of said frame is restricted, (m) a regnerative plate made of copper, having a portion detachably engageable with said auxiliary supporting frame and provided with an inflated roofing portion and an opening for guiding a quantity of hot air from said nozzle means into the inflated roofing portion, and (n) an orthopaedic means comprising said reforming plate and said auxiliary supporting frame.

* * * * *